United States Patent [19]

Nugent

[11] 4,253,324

[45] Mar. 3, 1981

[54] DRILL PIPE REFORMING METHOD AND APPARATUS

[76] Inventor: Jerry L. Nugent, 340 Aymar Comeaux Rd., Lafayette, La. 70508

[21] Appl. No.: 22,823

[22] Filed: Mar. 22, 1979

[51] Int. Cl.[3] ..... B21D 3/14

[52] U.S. Cl. ..... 72/393; 72/399

[58] Field of Search ..... 72/393, 399, 370, 367, 72/394, 452, 392; 29/402.01, 402.05, 402.19

[56] References Cited

U.S. PATENT DOCUMENTS

| | | | |
|---|---|---|---|
| 1,153,663 | 9/1915 | Wiedeke | 72/393 |
| 1,539,643 | 5/1925 | Bush | 72/393 |
| 1,719,720 | 7/1929 | Olsen | 72/393 |
| 2,461,565 | 2/1949 | Morrill | 72/393 |
| 2,818,102 | 12/1957 | Seifferle | 72/392 |
| 3,348,292 | 10/1967 | Turner | 29/506 |
| 3,550,424 | 12/1970 | Rast | 72/399 |
| 3,564,897 | 2/1971 | Rickard | 72/393 |
| 3,581,548 | 6/1971 | Hygren | 72/392 |
| 3,817,079 | 6/1974 | Priester | 72/392 |

*Primary Examiner*—Francis S. Husar
*Assistant Examiner*—Gene P. Crosby
*Attorney, Agent, or Firm*—Bard & Groves

[57] ABSTRACT

A method and apparatus is provided for reforming crushed or otherwise damaged drill pipe and the like. A plurality of expandable shoe elements are inserted into the large diameter portion of the drill pipe adjacent the crushed section. A ram or plunger is forced into and between the shoes to expand the shoes within the drill pipe for removing crushed portions thereof. More particularly, the length of travel of the plunger is coordinated to expand the shoes the proper extent to restore the drill pipe to its original configuration.

36 Claims, 8 Drawing Figures

FIG. 1
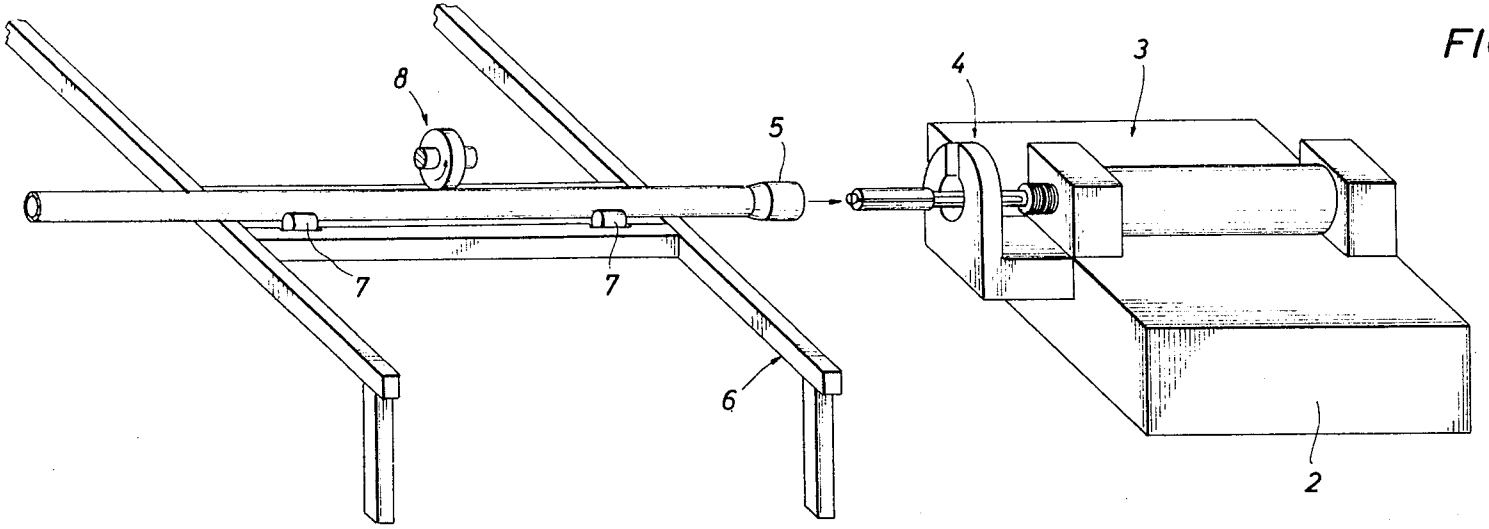
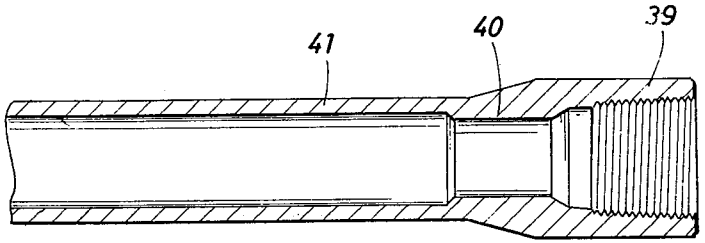
FIG. 8

DRILL PIPE REFORMING METHOD AND APPARATUS

BACKGROUND OF THE INVENTION

This invention relates to methods and apparatus for shaping metal cylinders and the like, and more particularly relates to improved methods and apparatus for reforming crushed drill pipe.

It is well known that oil and gas is found in subsurface earth formations, and that these petroleum substances are usually recovered through boreholes drilled into the formation from the surface. It is also well known that most such boreholes are drilled with rotary-type drilling equipment, wherein a "string" of drill pipe having a drill bit suspended at its lower end is revolved in the borehole to cut away the rock and other earth materials beneath the bit.

What is not well known outside of the drilling industry itself is that rotation of the drill string in the borehole tends to erode or abrade away the outside surface of the drill pipe, and this in turn tends to gradually reduce the tensile strength of the various lengths or sections of pipe composing the drill string. This, in turn, affects the overall integrity of the drill string, since the integrity of the drill string will obviously depend upon the strength of each section of pipe in the string.

It will be readily apparent that if the drill string breaks at any time during the drilling of the well, this will create a serious situation for both the well owner and the drilling contractor. It is extremely costly to drill a conventional oil or gas well, even without the additional expense of a special crew and equipment to fish out a section of the drill string from the borehole. Further, it is extremely expensive for the regular drilling crew to stand idly by with its equipment, while the fishing crew attempts to remove the lost section of drill string. Accordingly, the petroleum industry has necessarily adopted standards for evaluating the quality of drill pipe, and has further adopted a clearly recognized set of limits to determine the conditions under which so-called "used" or partly worn drill pipe may be employed to drill an oil or gas well.

The top grade of used drill pipe, which is commonly referred to as "premium", is drill pipe having at least 80% of its original wall thickness, and therefore such pipe will have a value approaching that of unused or new pipe, since it may be used to drill all but the very deepest of boreholes. "Class 2" drill pipe is that which has at least 65% of its wall thickness remaining, and "Class 3" drill pipe is that which has at least 55% of its original wall thickness remaining. "Class 4" drill pipe, which is ordinarily available only for drilling shallow water wells and the like, is pipe having less than 55% of its original wall thickness remaining.

It should be noted, however, that these standards only apply to drill pipe (other than Class 4 pipe) having no other flaws or defects such as cracks, dents or compressional deformities or the like. Thus, if a length of drill pipe has a dent or other flaw, it will usually be assigned to Class 3 or 4 regardless of its wall thickness, and will therefore have a market or sales value which is one-third or less than the usual value of pipe having such a wall thickness.

A length of drill pipe may, of course, become damaged or flawed for any number of different reasons. A particularly common occurrence is, however, for the pipe to be crushed under pressure of the slips in the rotary drilling table, where the drill string is being supported by these slips while sections of pipe are being unscrewed from or screwed onto the drill string. This may occur because the crewman is inadvertently applying too great a gripping pressure to the drill pipe, but it more often occurs because the slips or cones become worn to the extent that they tilt so as to apply pressure against too small a portion of the outside surface of the drill pipe.

It should be appreciated that, while this overcompression or crushing of the sections of drill pipe will occur at the same location (immediately below the box) along each section of pipe, the extent of such crushing will be relatively small and will usually not be visible to all but the most trained and experienced eye. Consequently, it will often occur that each section of an entire drill string of 15,000 feet or more will be crushed and thereby rendered unsuitable, before the problem is discovered. Moreover, this can occur regardless of the initial grade or class of the drill pipe, and thus the entire length of a drill string worth over $300,000.00 (at $21.00 per foot) may, in a few minutes, be inadvertently reduced to its scrap value. Further, there is the additional expense of having the drilling rig and crew stand down while an attempt is made to acquire a new drill string which may, or may not be, immediately available.

There have been many attempts to meet this problem, and in particular there have been attempts made to develop apparatus to reform crushed drill pipe by internally squeezing it outwardly to its original shape. For example, there may be seen the devices which are disclosed, for example, in U.S. Pat. Nos. 1,153,663 and 2,461,565, which provide for applying pressure to swell the pipe. Even though the extent of the crush usually experienced is relatively minor, as hereinbefore stated however, such attempts have not been acceptable to the industry for several reasons.

First, it should be noted that the reforming operation must be performed without heating or otherwise distorting the drill pipe so as to further affect its tensile strength. Accordingly, this requires that the reforming step be performed as sharply and abruptly as the original crushing step was performed.

Second, and perhaps because of this first aspect of the problem, it should be noted that the reforming step must be performed so that the pipe is swelled to only its original shape, since an outwardly bulged length of drill pipe will be rejected for the same reason that the crushed section was rejected. Even the slightest degree of overreforming is unacceptable, and since the reforming step must be performed within the section of pipe where it cannot be observed, it will readily be apparent that this is no simple task.

Third, any apparatus for reforming crushed drill pipe must, to be acceptable, be capable of handling a large number of sections of drill pipe within a relatively small time interval, and with a minimum amount of expertise on the part of its operator. None of the techniques and devices which have heretofore been proposed, however, have met these requirements to an extent acceptable to the industry.

Another reason why the prior art devices have been unsuitable for reforming drill pipe involves the peculiar special shape of a length of drill pipe as such. More particularly, it should be noted that not only does drill pipe commonly have a relatively thick or heavy wall in contrast to well casing and the like, it also has an even smaller diameter throat section adjacent the "box" or internally threaded portion at its upper end. Thus, a section of drill pipe is provided with an abnormally heavy wall section which creates a restriction in the form of an annular shoulder within the interior of the drill pipe. Further, this internal restriction or narrowing is located below the box but above the section of pipe which usually experiences crushing.

It will thus be apparent that, if a device is inserted into the end of the pipe to apply an expanding pressure at the zone of the crush, the device must not only be collapsible to an extent that it is insertable into the crushed section, but it must be further collapsible to an extent that it pass through this particularly narrow section below the box but above the crushed section of the pipe. This, of course, is in addition to the other requirements of the device, as hereinbefore set forth, and thus it will readily be apparent why devices such as those depicted or suggested in U.S. Pat. Nos. 1,153,663 and 2,461,565 have not been accepted by the industry for the purposes recited.

These disadvantages of the prior art are overcome with the present invention, however, and improved methods and apparatus are herewith provided for restoring crushed drill pipe sections and the like to their original configuration and condition.

SUMMARY OF THE INVENTION

In accordance with the concepts of the present invention a pipe rack for damaged drill pipe is provided and including means for individually and sequentially feeding separate pipe sections to a forming machine. The forming machine receives the damaged section of drill pipe and includes a power tong to assist in connecting the drill pipe section to be reshaped to the forming apparatus. Once connected, the forming machine drives a plunger device into the interior of the drill pipe and reshapes the pipe by removing from the wall of the pipe crimps, indentations, or crushed-in areas. After being reformed and upgraded, the section of drill pipe is removed from the forming machine and another damaged section of drill pipe moved into position for reshaping.

The forming machine includes a hydraulically actuated piston which drives a plunger member axially into and through the damaged drill pipe section in the area of the crimp, indentation or concave area of the pipe. The plunger cooperates with an expandable force applying member which spreads apart thus transmitting an outward radial force to the inner wall of the drill pipe section. Such outwardly acting radial force removes the crimp from the damaged drill pipe section whereby this pipe section may be upgraded again for reuse in the string of the drilling operation.

The plunger member of the forming machine is more or less needle-shaped or of decreasing cross-sectional area from one end to the other. The expandable member includes a plurality of flexible pipe wall engaging shoe elements which move radially outwardly against the inner wall of the pipe sought to be reshaped. Increase of the axial driving force on the plunger member will in turn increase the radially acting force transmitted to the pipe wall by the sections of the expandable member thus tending to remove crimps, indentations, and crust points, from the wall of the pipe section undergoing reforming.

Reversal of hydraulic pressure on the piston of the forming machine removes the plunger from the expandable member and the reformed drill pipe section is telescoped from the expandable member. The reformed and reshaped drill pipe section is then set aside for regrading, preferably upgrading from its previous damaged status, and another drill pipe section brought to the forming machine for treatment.

This invention therefore provides improved methods and apparatus for reforming and reshaping damaged tubular conduit having at least two sections of varying diameters and wherein the damaged area of the pipe resides in the larger diameter section of the pipe. A pipe rack is provided for feeding damaged pipe to a power tong and each individual pipe section is moved up to a reforming machine. The machine includes a plunger or ram adapted to pass axially through the pipe or workpiece to be treated, and there is located within the workpiece an expandable assembly comprising a plurality of segmented shoes which are radially expandable into the larger diameter portion of the workpiece. The shoes reside entirely within the larger diameter confines of the workpiece and a corresponding number of flexible straps extend from the shoes and out of the small diameter section of the workpiece. Actuation of the ram or plunger forces movement of this member through the small diameter section of the workpiece and within the confines of the flexible straps. The plunger continues through the small diameter of the workpiece and into the larger diameter section containing the radially expandable shoes. The plunger has a taper opposite the taper of the shoe assembly and therefore as the plunger continues its axial travel, the shoes are caused to expand radially and into the exposed wall of the workpiece. Such movement of the shoes removes damaged areas in the wall of the workpiece and restores the workpiece to an otherwise reusable item. The plunger is removed, the shoes collapse, and the plunger retracts again from the small diameter portion of the workpiece. The reformed workpiece is then removed from the reforming apparatus and another damaged workpiece treated in the manner set forth hereinabove.

In the preferred form of the invention, drill pipe is reshaped and crushed-in areas in the large diameter section of the drill pipe are removed by inserting expandable shoes through the throat of the pipe and into the large diameter section thereof. Flexible interlinking straps connected to the shoes provide a means of inserting the shoes through the pipe throat and fully into the large diameter section of pipe containing the damaged area. Passage of the plunger through the throat which is occupied by the straps does not actuate the shoes, and such shoes are not actuated until the plunger reaches the larger cross-sectional area of the drill pipe which is occupied by the shoe elements. Contact of the plunger or ram with the shoes thereupon provides for full expansion radially of the shoes into and against the damaged pipe wall area and without restriction of movement due to the presence of the drill pipe throat area.

It should be apparent from the above that with the methods of the herein described invention and when employing the apparatus depicted and described herein, that it will no longer be required to discard or downgrade damaged drill pipe but that such damaged pipe sections may be reformed, reshaped, and upgraded for recycle into the drilling operation sequence.

It is therefore a feature of the present invention to provide a simple expanding tool for drill pipe that can be actuated selectively during operation in order to remove damaged areas from the drill pipe that reside incrementally along its axial length.

It is another feature of the present invention to provide a method and associated apparatus for restoring to shape conduit having more than one internal diameter.

It is yet another feature of the present invention to treat tubular articles that have a first small diameter opening therein followed by a second opening of larger diameter and wherein the damaged area of the article to be treated resides in the wall section of the article having the second and larger diameter. In a particular form, expandable shoes are selectively actuated only in the large diameter section of the article to be treated by virtue of a series of flexible linking means that occupy the small diameter section of the article or workpiece.

These and other features and advantages of this invention will become apparent from the following detailed description and wherein reference is made to the figures in the accompanying drawings.

DRAWINGS

FIG. 1 shows a simplified pictorial representation of the basic components of a drill pipe reforming system embodying the concept of the present invention.

Figure 2:
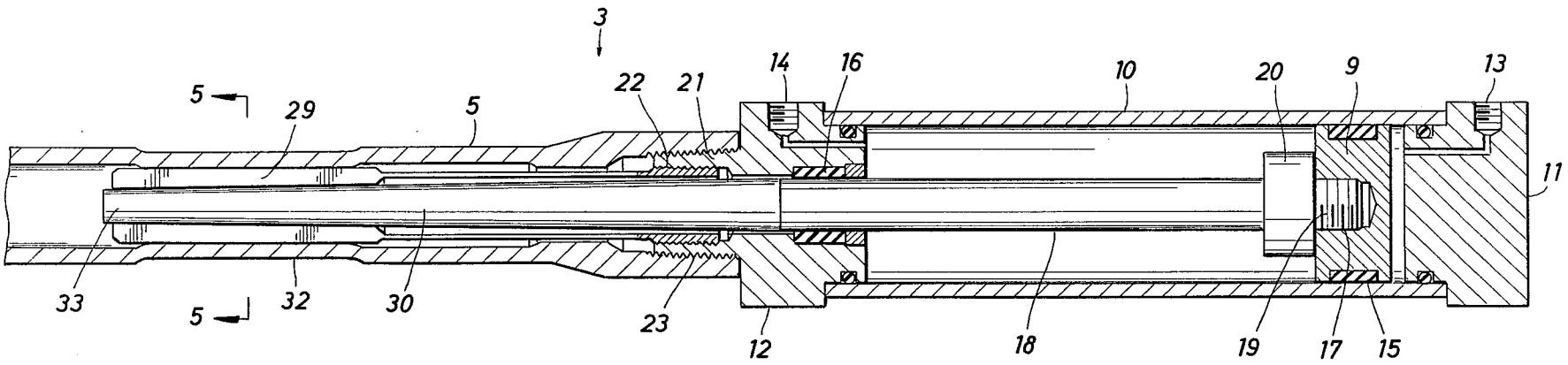
FIG. 2 is a simplified pictorial representation of the hydraulic ram reforming apparatus of the present invention with the ram in the retracted position.
Figure 3:
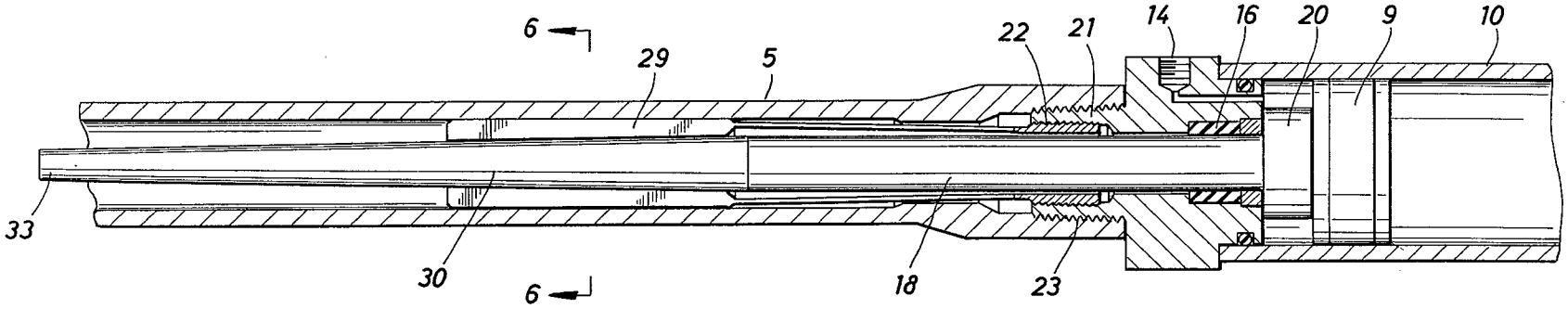
FIG. 3 is a simplified pictorial representation of the hydraulic ram reforming apparatus of FIG. 2 but with the ram in the extended position.
Figure 5:
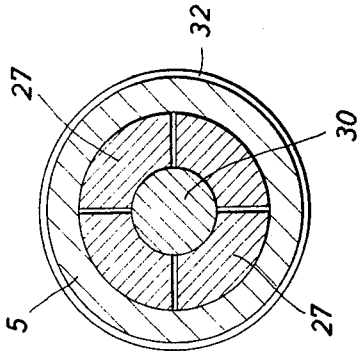
Figure 6:
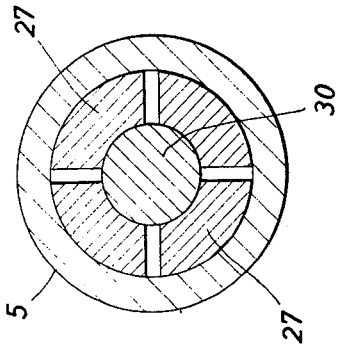

FIGS. 5 and 6 are simplified pictorial representations in cross section and taken along the lines 5—5 and 6—6 of FIGS. 2 and 3 respectively.

Figure 7:
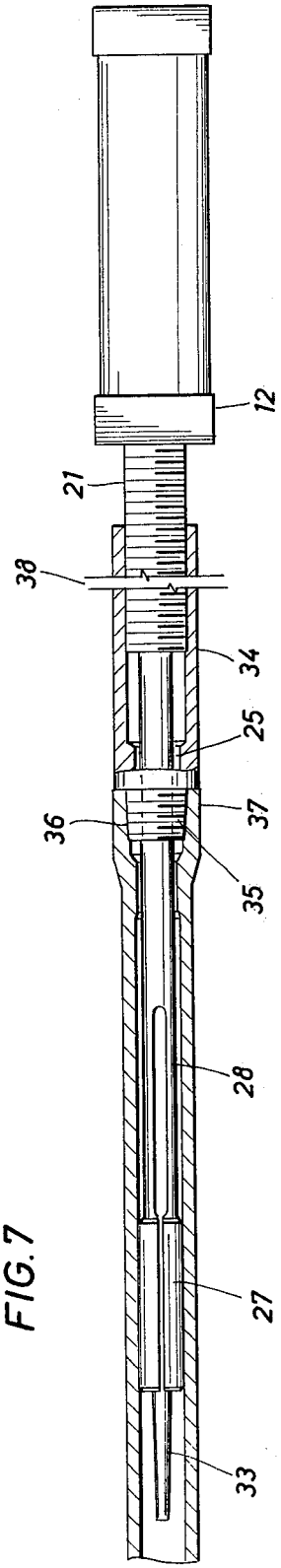

FIG. 7 is a simplified pictorial representation of an alternate form of the hydraulic ram reforming assembly.

FIG. 8 is a simplified pictorial representation of one end of a standard piece of drill pipe and setting forth in more detail the particular variances in cross-sectional area found therein.

DETAILED DESCRIPTION

Referring now to FIG. 1, there is set forth therein in more or less detail an overall view of a system for effecting reforming of damaged conduit, more particularly drill pipe. There will be seen a jig assembly 2 having mounted thereon the forming or reshaping apparatus 3 of the present invention. The reforming apparatus is set forth in more detail in FIGS. 2 and 3, however.

With reference again to FIG. 1, jig assembly 2 includes in addition to the reforming apparatus 3 a power tong 4 of conventional design and which functions to hold the workpiece or drill pipe 5 in a stationary position when the reforming machine 3 is is operation. A pipe rack 6 is provided adjacent jig 2 and includes a set of rollers 7 for revolving workpiece 5 when the workpiece 5 is being connected and disconnected from the reforming machine 3. A power driven tightening and untightening wheel 8 is included on pipe rack 6 and functions to assemble and disassemble the workpiece 5 from the reforming apparatus 3.

In overall operation and viewing again FIG. 1, pipe rack 6 is loaded with several workpieces or drill pipes 5 that have been damaged in use and require reforming to remove crimps or crushed areas from the wall thereof. A single pipe 5 is moved to rollers 7 and forced axially onto reforming machine 3. Wheel 8 moves into engagement with pipe 5 and tightens pipe 5 onto reforming apparaus 3. The power tong 4 is then actuated to grip pipe 5 in a stationary fashion, and then the reforming apparatus is energized to perform its intended function. After the pipe 5 has been reformed or reshaped by apparatus 3, power tongs 4 are released. Wheel 8 is again moved into position adjacent pipe 5 and the pipe is disconnected from reformer 3. Pipe 5 is then removed from pipe rack 6 and placed aside for upgrading. Another drill pipe 5 is then moved to rollers 7 and the operation as above described repeated.

It should be noted that the essential feature of the present invention is the reforming apparatus 3 shown generally in FIG. 1, and which will be described in greater detail hereinafter with reference to FIGS. 2–4. The other supporting assemblies of FIG. 1 for delivering and removing drill pipe 5 to and from the reforming apparatus are shown more or less for convenience in the understanding of the invention and it is contemplated that other and equivalent supporting assemblies may be employed, if desired.

Referring now to FIG. 2, there will be seen the reforming apparatus 3 of FIG. 1 in greater detail and with the ram or plunger in the retracted position. A hydraulically actuated piston 9 is provided in cylinder 10 with cylinder heads 11 and 12 at each end. Ports 13 and 14 are provided in cylinder heads 11 and 12 and provide the means for retracting and extending the piston 9 as is well known in the art. Suitable seals 15 and 16 are included in the piston assembly as is also conventional.

Piston 9 is provided with a center screw threaded opening 17 and attached thereto is the ram or plunger member 18 via the shank portion 19 of the ram 18. A bumper or guard member 20 can be concentrically arranged on ram 18 for absorbing any shock as the piston 9 and ram 18 are extended. It should be apparent that application of a hydraulic or pneumatic pressure to one or the other of ports 13 and 14 will cause piston 9 together with ram 18 to extend or retract within cylinder 10.

Cylinder head 12 includes thereon a collar member 21 that has inner and outer screw threads 22 and 23 respectively. The outer screw threaded section 23 of collar 21 receives the drill pipe 5 and provides the means of attaching the workpiece 5 to the assembly. The inner screw threaded section 22 of collar 21 functions to attach to the cylinder head 12 the expandable shoe assembly 24 depicted more particularly in FIG. 4.

Figure 4:
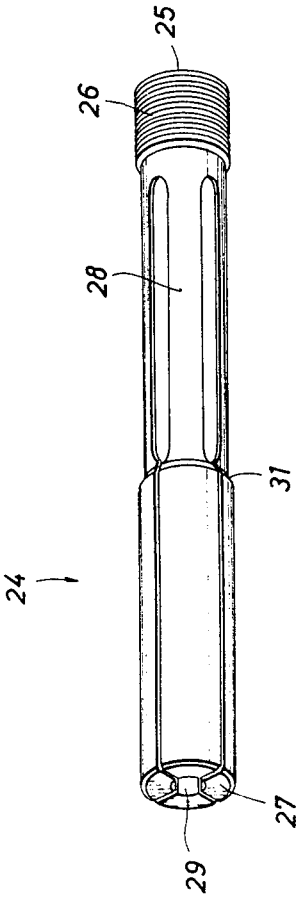
FIG. 4 is a simplified pictorial representation of a portion of the apparatus of FIG. 2, and more particularly showing the expandable shoe elements and the flexible linking straps connected thereto.

In FIG. 4 the expandable shoe assembly 24 is set forth in more detail and comprises a sleeve 25 having exterior screw threads 26. Screw threads 26 are otherwise adapted to be made up to the inner section 22 of the screw threads of collar 21 in FIG. 2. Again in FIG. 4, a plurality of segmented radially expandable shoes 27 are depicted and being interconnected to sleeve 25 by means of a corresponding plurality of flexible linking means or strap members 28. While for shoes 27 are seen and illustrated in FIG. 4, other numbered arrangements could be provided, for example, five shoes 27 and even up to eight or more of the shoes. In any event, regardless of the number of shoes 27, there would be a corresponding number of straps 28 to provide the connection between the shoes 27 and the sleeve 25.

It shold be apparent that in viewing FIGS. 2 and 4, that in the reforming apparatus 3, the expandable assembly 24 is disposed within the drill pipe or workpiece 5 and with the ram 18 adapted to pass within the expandable assembly 24. Thus, there is a concentric arrangement of parts with the inner and outer parts being the ram 18 and drill pipe 5 respectively, which ram 18 and pipe 5 sandwich therebetween the expandable assembly 24.

As noted above, each of the shoes 27 are segmented in cross-section and further include an inner tapered bore 29, which bore taper is more clearly depicted in FIG. 2, for example. Also, as seen in FIG. 2, the terminal portion 30 of ram 18 is tapered to correspondingly and matingly fit with the taper 29 of the assembly of shoes 27. Such complementary and tapering surfaces 29 and 30 provide for the ram 18 to exert a uniform radially outward driving force to each of the shoes 27 and to thereby force the shoes 27 into the wall of the drill pipe in order to reform and reshape any damaged or crushed-in areas that may be present therein. Shoes 27 are otherwise comprised of solid members from end to end as depicted in FIG 4, for example.

Further and again in regards to FIG. 4, it should be understood that straps 28 perform no expanding or force applying function as do the shoes 27. The straps 28 rather merely link sleeve 25 and shoes 27 together as a unit, and allow radial expansion of the shoes 27 when ram end 30 is passed therewithin. It is the primary function of the straps to prevent expansion of the shoes 27 up and until the time ram end 30 actually enters the forward end 31 of the series of shoes 27. Up until that time, shoes 27 remain retracted. Thus, as ram end 30 enters sleeve 25 and passes interiorly of straps 28, shoes 27 remain retracted. It is only when ram end 30 enters end 31 of the shoe assembly 27 that the individual shoes begin to be expanded by the ram.

For this purpose and referring to FIG. 2 again, each strap 28 is elongated and of thin flexible construction. The inner annulus defined by the straps 28 is of course of less cross-sectional diamter than the cross-sectional diameter of the shoes 27 provided a free passage of the ram end 30 therethrough without engagement and without radial deflection of the straps 28.

In view of the above, and viewing FIG. 2, it should be understood that the longer is the length of the straps 28, then the longer is the stroke of the piston 9 required before ram end 30 reaches shoes 27 for expansion of the shoes into the pipe wall of the workpiece 5. The straps 28 thus provide a means for selectively placing the shoes 27 at any point along the length of the workpiece 5 wherein it is desired to reshape the pipe wall. At the same time, and due to the non-engagement of ram end 30 with the straps 28, the expansion function of the shoes 27 is prevented.

The damged area 32 is shown in FIG. 2 and may comprise a crushed section in the wall of drill pipe 5. An expandable assembly 24 is first selcted and which includes a shoe assembly 27 having a length approximating the length of damaged area 32. Assembly 24 must also include straps 28 having a length such that the shoes 27 will reach the area of the damaged section of pipe 32.

Assembly 24 is thereupon connected to cylinder head collar 21 by mating screw threaded sections 26 and 22. The drill pipe 5 including the damaged area 32 is then connected to collar 21 and in surrounding relation to assembly 24. Piston 9 is seen in its retracted position in FIG. 2 but with the tapered ram end 30 extending through collar 21 and sleeve 25. The ram end 30 is also within the area of the straps 28 but not in engagement therewith. Further, the terminal end 33 while being received in the shoe assembly 27 is not as yet exerting any radial driving force to the shoes 27. This condition can be more effectively realized by reference to FIG. 5 for example wherein all of the assembled components are depicted in more or less loose fitting relationship.

In a reshaping operation, however, and as depicted and illustrated in FIG. 3, fluid pressure is applied to port 13 of cylinder head 11. Piston 9 is forced toward cylinder head 12 with the result that ram 18 moves to the right as seen in FIG. 3. This movement of ram 18 forces end 33 of the tapered section 30 of the ram through the shoe assembly 24 with the result that enormous radial pressure is applied by ram section 30 to each of the individual shoes 27. The shoes 27 radially expand against the pipe wall of workpiece 5 and the previous damaged area 32 of the workpiece is forced into round again. In any event and as seen in FIG. 3, straps 28 remain out of contact with the ram 30 even during expansion of the shoes 27 and thus provide a flexible linkage for expanding the workpiece 5 at any preselected point along its length. This condition is more aptly seen in FIG. 6 wherein all parts are shown in expanded condition and with the damaged area 32 removed and the workpiece 5 being in round again. Workpiece 5 is then removed from collar 21 and the process is repeated again with another damaged drill pipe.

While it has hereinbefore been stated that various sub-assemblies 24 may be constructed of varying lengths and diameters in order to reach various damaged areas 32 along the length of a workpiece 5 to be reshaped, other alternative and equivalent means may be employed to adjust and vary the location of the shoes 27 at selected points along the length of the workpiece 5 to be treated in accordance with the novel concepts set forth herein. This may be exemplified by the concept of FIG. 7 wherein an embodiment of the apparatus of FIGS. 2–6 is seen with other of the components thereof being substantially identical and similarly numbered for clarity and understanding.

The only substantial difference between the structure of the embodiment of FIG. 7 and that of FIGS. 2–6 is that the collar 21 of the cylinder head 12 which is shown in FIG. 7 has a substantial length. It is this lengthened collar 21 that provides the adjustment if desired of the location of shoes 27 into and along workpiece 5.

In FIG. 7, coupler member 34 is provided and adapted to be screw-threadedly moved along cylinder head collar 21. Coupler 34 includes therein the expandable assembly 24 with collar 25 attached thereto and with straps 28 and shoes 27 extending therefrom. Coupler sleeve 35 is integral with coupler member 34 and provides outer screw threads 36 for connection of the threaded end 37 of the drill pipe 5 or workpiece to be reshaped. It should be apparent that movement selectively of coupler 34 on cylinder head collar 21 will in turn move the shoe assembly 27 to variable locations along and within the confines of the workpiece 5. Broken line section 38 provides that the coupler assembly 21, 34 could be of whatever suitable length is found necessary to reform a wide variety of different lengths of workpieces 5 and including a wide variety of damaged areas 32 at various locations along their lengths. Otherwise, the operation of the apparatus of FIG. 7 is the same as that above described with reference to FIGS. 2–6.

As noted hereinbefore, the apparatus of the present invention is particularly suited and in the preferred mode is operative to reshape and reform drill pipe. To this end, FIG. 8 is provided to illustrate the unique and somewhat troublesome construction of drill pipe and to depict the problem areas present when conventional pipe extending apparatus is attempted to be adapted thereto.

As illustrated in FIG. 8, most industrial drill pipe includes a tapered section 39 interiorly screw threaded and of a substantial thickness for the purpose of resisting lateral cracking when another joint is connected thereto. The drill pipe further includes a larger diameter inner flow section 41 with a much smaller diameter throat section 40 communicating sections 39 and 41 of the drill pipe end as seen. In use, damage generally occurs somewhere along the length of section 41 of the drill pipe, however.

This necessitates that repair tools enter section 39 of the pipe, through throat 40 and into section 41. However, the prior art expanding tools includes continuous expandable shoes such that while the shoes may be small enough to enter section 41 through throat 40, nevertheless expansion of these continuously constructed shoes will be limited by the throat section 40 with the result that the damaged area in section 41 will never be reached by the shoe assemblies of the prior art devices.

It is to correct this deficiency of the prior art devices that the straps 28 of the assembly 24 of FIG. 4 are necessitated. Thus, with the subassembly of FIG. 4, shoes 27 may be inserted fully into section 41 of the drill pipe, but with the throat section 40 being occupied only by the straps 28 that connect the shoes to the sleeve 25. In this manner, ram 30 may pass freely through the throat 40 and without actuating the radial expansion of the shoes 27 until it reaches the confines of section 41 where shoes 27 are located. Prior to entry of ram end 33 into the shoe assembly 27 within section 41 of the drill pipe, no obstruction is provided by the straps 28 nor are the shoes 27 moved until contact is made. Thus, the subassembly of FIG. 4 with the flexible linking straps 28 overcomes the delimiting feature of the throat 40 of the drill pipe of FIG. 8.

From the foregoing, it should be apparent that if the prior art devices of, for example, U.S. Pat. No. 1,153,663 and 2,461,565 were attempted to be used to expand, reform, or reshape drill pipe, they would be hindered in their operation because of the small diameter throat 40 of the drill pipe. For example, such devices could conceivably be constructed small enough to pass through the throat section of the drill pipe and into and along the large diameter crushed flow portion 41 of the pipe. However, when the plunger or ram of such prior art devices is actuated to expand radially outwardlyhe various cooperating shoe elements into engagement with the large diameter flow section 41 of the pipe, such shoes are limited in their radial expansion to only the wall of the throat portion 40 of the drill pipe. Thus, the expandable shoes of the prior art devices will merely jam against the annular wall defining the throat or small diameter section 40 of the drill pipe and without ever actually coming into radially outward engagement with the damaged large diameter pipe wall section 41.

It should therefore be apparent that the devices of the prior art, and in particular U.S. Pat. Nos. 1,153,663 and 2,461,565, are only effective where the conduit to be reformed is of a single diameter, and that in the treatment of conduit such as drill pipe wherein there is provided at least two sections 40 and 41 of differing diameters, these prior art devices are rendered practically useless in any utilitarian function.

Many other alternative forms of the present invention will of course become apparent from the foregoing methods and apparatus for reshaping and reforming conduits. Accordingly, the structures and techniques hereinbefore depicted and discussed are illustrative only and are not intended as limitations on the scope of the present invention.

What is claimed is:

1. Apparatus for reforming a crushed section of a pipe member having a threaded end portion and an interior annular shoulder portion located between said crushed section and said threaded end portion, comprising an elongate plunger member adapted for at least partial insertion longitudinally into and through said threaded end and interior shoulder portions and along the length of said crushed section of said pipe, a plurality of shoe members shaped to form a segmented hollow and generally cylindrical assembly having a cross-sectional diameter less than the inside diameter of said pipe member at said annular shoulder portion and positionable within and along the length of said crushed section of said pipe member, driving means for thrusting at least a portion of said plunger member through said cylindrical assembly of shoe members a preselected distance, and a plurality of link members interconnected between said driving means and said plurality of shoe members.

2. The apparatus described in claim 1, wherein at least a portion of said plunger member is thrustable through said cylindrical assembly by said driving means to urge one or more of said shoe members radially outwardly against the inside surface of said crushed section of said pipe member.

3. The apparatus described in claim 2, wherein said driving means is interconnectable with said threaded end of said pipe member to position said cylindrical assembly of shoe members within and along the length of said crushed section of said pipe member.

4. The apparatus described in claim 3, wherein said shoe members are further adapted to form a cylindrical assembly having length greater than the length of said crushed section of said pipe member but not great enough to also extend into said annular interior shoulder portion thereof.

5. The apparatus described in claim 1, wherein said plunger member is interconnected with said driving means to be slidably movable through said cylindrical assembly of shoe members between a first position wherein the cross-sectional diameter of said cylindrical assembly is less than the inside diameter of said shoulder portion of said pipe member and a second position wherein the cross-sectional diameter of said cylindrical assembly approximately corresponds to the original inside diameter of said pipe member.

6. The apparatus described in claim 5, wherein each of said plurality of link members is interconnected between said driving means and a corresponding one of said shoe members.

7. The apparatus described in claim 5, wherein said driving means further comprises connector means for threadedly engaging said threaded end portion of said pipe member for immobilizing said pipe member during slidable movement of said plunger member through said cylindrical assembly of shoe members, and hydraulic cylinder means to drive said plunger member between said first and second positions.

8. The apparatus described in claim 7, wherein said plunger member includes a piston portion located at one end thereof and slidably positionable within said hydraulic cylinder means, and a tapered rod-like portion of the other end thereof for urging one or more of said shoe members radially outwardly against said crushed section of said pipe member.

9. The apparatus described in claim 8, further comprising a pipe rack for holding a plurality of pipes to be reformed.

10. The apparatus described in claim 9, further including roller means on said rack for supporting said pipe, and tightening means engageable with said pipe for rotating said pipe to thread said threaded end portion of said pipe member to said connector means.

11. The method of reforming a crushed section of a pipe member having a threaded end portion and an interior annular shoulder portion located between said crushed section and said threaded end portion, comprising the steps of:

inserting an elongate tapering plunger member longitudinally into and through said threaded end and interior shoulder portions and along the length of said crushed section of said pipe, arranging a plurality of shoe members within and along the length of said crushed section of said pipe member to form a segmented hollow and generally cylindrical assembly having a cross-sectional diameter less than the inside diameter of said pipe member at said annular shoulder portion, and thrusting said plunger member slidably through said cylindrical assembly of shoe members a preselected distance functionally related to the diameter of said assembly and the angle of taper of said plunger member.

12. The method described in claim 11, further comprising restraining longitudinal movement of said shoe members within said pipe member when said plunger member engages said cylindrical assembly.

13. The method described in claim 11, wherein said plunger member is thrusted through said cylindrical assembly to urge one or more of said shoe members radially outwardly against the inside surface of said crushed section of said pipe member.

14. The method described in claim 13, wherein said plunger member is slidably moved through said cylindrical assembly of shoe members between a first position wherein the cross-sectional diameter of said cylindrical assembly is less than the inside diameter of said shoulder portion of said pipe member and a second position wherein the cross-sectional diameter of said assembly corresponds to the original inside diameter of said pipe member.

15. The method described in claim 14, further comprising immobilizing said pipe member during slidable movement of said plunger member through said cylindrical assembly of shoe members.

16. Apparatus for reforming damaged drill pipe and the like comprising:

a fluid actuated piston assembly having a cylinder head at one end thereof, collar attachment means connected to said cylinder head and including interior and exterior threads, a tapered ram connected to said piston and adapted to move from a retracted position to an extended position, passageway means in said cylinder head and collar means allowing movement of said ram therewithin, an externally threaded sleeve member connected to the interior threads of said collar means, said drill pipe being adapted to be connected to the exterior threads of said collar means, a plurality of flexible straps extending from said sleeve and into the interior of said drill pipe, a corresponding plurality of segmented solid collapsible and expandable shoe elements positioned within said drill pipe and being connected to said flexible straps, said shoe elements in the collapsed position defining an interior passageway of a taper corresponding to the taper of said ram, and means for actuating said piston to extend said ram through said passageway means, said straps and into the tapered passageway of said shoe elements, to cause said shoe elements to expand radially into and against the wall of said drill pipe.

17. Apparatus for reforming damaged tubular conduit having at least two cross-sectional areas of differing diameters and with the damaged area residing in the larger diameter portion thereof comprising:

a fluid actuated piston assembly including a tapered ram attached to said piston and extending through a cylinder head of said assembly, said cylinder head including first and second connector means allowing passage of said ram therethrough, an expandable assembly connected to said first connector means of said cylinder head and including a plurality of flexible thin straps and a corresponding plurality of expandable shoe elements, said conduit being adapted to be attached to said second connector means of said cylinder head and with said shoe elements residing wholly within the confines of the larger diameter portion of said conduit and in the area of damage, and means for driving said ram into said shoe elements to expand said elements radially into the wall of said conduit.

18. Apparatus for reforming conduit having a small diameter entrance end followed by a passageway of greater diameter comprising:

an expandable assembly including a plurality of thin flexible straps attached to a plurality of segmented shoes, said assembly being of a size to pass through said small diameter entrance end of said conduit and with said straps occupying both the entrance end and passageway of said conduit, said shoes adapted for placement entirely within the area of said passageway of greater diameter, and force applying means extendable into and through said entrance end and said shoes to radially expand said shoes outwardly against the inner surface of said conduit.

19. The apparatus described in claim 18, wherein said force applying means comprises an elongate tapered plunger member movable between a first position wherein the cross-sectional diameter of said expandable member is less than said small diameter entrance end and a second position wherein the cross-sectional diameter of said expandable member is approximately equal to the original diameter of said passageway.

20. The apparatus described in claim 18, wherein each of said plurality of flexible straps is connected to a corresponding one of said segmented shoes.

21. As a subcombination;

an annular sleeve member having external threads thereon, a plurality of thin flexible straps attached to said sleeve member at one end thereof, a corresponding plurality of shoe elements attached to said straps, each of said shoes being segmental in cross-section and of solid construction and being expandable and contractable as a unit, and said shoe elements in the contractable position defining as a unit within the confines thereof a tapered bore extending the length thereof.

22. A method of reforming damaged drill pipe having a small diameter entrance passageway followed by a large diameter flow passageway and wherein the damaged area resides in said flow passageway, comprising the steps of:

passing a plurality of expandable shoe elements through said entrance passageway and into said flow passageway, positioning said shoe elements entirely within said flow passageway at a location adjacent said damaged area, inserting a force applying means through said entrance passageway and into said shoe elements in said flow passageway, and expanding said shoe elements into said damaged area of said drill pipe.

23. The method as defined in claim 22, wherein said force applying means is inserted through said flow passageway a preselected distance.

24. The method as defined in claim 22, wherein each of said shoe elements is positioned within said flow passageway by a respective link member connected to said shoe element.

25. The method as defined in claim 22, wherein said force applying means is an elongate tapered plunger member responsive to a fluid activated piston assembly.

26. The method as defined in claim 22, wherein said plurality of expandable shoe elements are arranged to form a segmented hollow and generally cylindrical assembly.

27. The method as defined in claim 26, wherein said force applying means is inserted through said entrance passageway to a position wherein the cross-sectional diameter of said cylindrical assembly is approximately equal to the original diameter of said flow passageway.

28. Apparatus for reforming damaged drill pipe having a small diameter entrance passageway followed by a large diameter flow passageway and wherein the damaged area of the drill pipe resides in the flow passageway, comprising:

a plurality of expandable shoe elements positioned wholly within said flow passageway adjacent the damaged area thereof, driving means for moving a force applying means through said entrance passageway and into said shoe elements in said flow passageway to expand said shoe elements radially outwardly and into the damaged area of said drill pipe, and a plurality of thin straps each connected at one end to said shoe elements and the other end of said straps extending through said entrance passageway.

29. The apparatus of claim 28 wherein said driving means comprises a fluid actuated piston and said force applying means includes a ram connected to said piston.

30. The apparatus of claim 29 wherein said shoe elements are segmental in cross-sectional area and of solid construction.

31. The apparatus of claim 30 wherein said shoe elements are collapsible and expandable as a unit and in the collapsed condition define an interior tapered bore extending along the length thereof.

32. The apparatus of claim 31 wherein said ram is tapered to correspond to the bore of said shoe elements.

33. The apparatus of claim 29, wherein said piston includes a cylinder head having a connector means attached thereto, and wherein said other end of said straps are attached to said connector means, said drill pipe being adapted to be attached to said connector means and with said drill pipe entrance passageway being in surrounding and concentric relationship to said other end of said straps.

34. The apparatus of claim 33 wherein said connector means comprises an externally and internally threaded collar, an externally threaded sleeve attached to said other end of said straps and with the threads of said sleeve matingly engaging the internal threads of said collar, and said entrance passageway of said drill pipe being internally threaded and in engagement with the external threads of said collar.

35. A method of reforming pipe having an entrance passageway of a first diameter and a flow passageway of a larger second diameter and wherein the damaged area resides in said flow passageway, comprising positioning a plurality of expandable shoe elements within said flow passageway at a location adjacent said damaged area, retaining said shoe elements in a fixed longitudinal position by link members connected to said shoe elements, inserting a force applying means through said first diameter passageway and into said shoe elements within said flow passageway, and expanding said shoe elements into said damaged area of said pipe until said shoe elements return said damaged area to approximately the original larger second diameter.

36. The method as defined in claim 35, wherein each of said shoe elements is longitudinally positioned within said flow passageway by a respective link member connected at one end to said shoe element.

* * * * *